United States Patent [19]

Yamaguchi et al.

[11] 3,935,340

[45] Jan. 27, 1976

[54] PROCESS FOR PREPARING PLASTIC COATED METAL POWDERS

[75] Inventors: Tadashi Yamaguchi; Takayuki Ono, both of Sendai; Hiroshi Hoshi, Narashino; Michio Hirakawa; Isao Watanabe, both of Ichikawa, all of Japan

[73] Assignee: Lion Yushi Kabushiki Kaisha, Tokyo, Japan

[22] Filed: Dec. 3, 1973

[21] Appl. No.: 421,321

[30] Foreign Application Priority Data

Dec. 4, 1972 Japan ..... 47-121357

[52] U.S. Cl. ..... 427/216; 427/221; 428/407

[51] Int. Cl.[2] ..... B05D 7/00

[58] Field of Search ..... 117/100 M, DIG. 3; 260/42.53; 427/216, 221; 428/407

[56] References Cited

UNITED STATES PATENTS

| | | | |
|---|---|---|---|
| 3,068,185 | 12/1962 | Stamberger | 260/42.53 |
| 3,185,589 | 5/1965 | Damm | 117/100 M |
| 3,448,073 | 6/1969 | McManimie | 260/42.53 |
| 3,468,828 | 9/1969 | Perrins et al. | 260/42.53 |
| 3,519,594 | 7/1970 | Michaels | 260/42.53 |
| 3,526,533 | 9/1970 | Jacknow et al. | 117/100 M |
| 3,533,835 | 10/1970 | Hagenbach et al. | 117/100 M |
| 3,547,822 | 12/1970 | Miller | 117/100 M |
| 3,635,752 | 1/1972 | Baer et al. | 260/42.53 |
| 3,657,144 | 4/1972 | Yoshida | 117/100 M |
| 3,661,620 | 5/1972 | Dekking et al. | 117/62.2 |
| 3,669,885 | 6/1972 | Wright et al. | 117/100 M |
| 3,718,594 | 2/1973 | Miller | 117/100 M |

*Primary Examiner*—William D. Martin
*Assistant Examiner*—Dennis C. Konopacki
*Attorney, Agent, or Firm*—William J. Daniel

[57] ABSTRACT

Metal powder is suspended in an aqueous medium containing a radical-polymerizable monomer and polymerization is conducted in the presence of an acidic sulfite ion to produce a plastic coated metal powder which is effectively used for forming conductive plastics, molded articles for sintering, pressed powder magnetic cores and the like.

8 Claims, No Drawings

PROCESS FOR PREPARING PLASTIC COATED METAL POWDERS

BACKGROUND OF THE INVENTION

Field of the Invention:

The present invention relates to a process for preparing plastic coated metal powders suitable for forming conductive plastics, molded articles for sintering and pressed powder magnetic cores.

Description of the Prior Art:

As a process for coating solid particles with a plastic material, there have been known various processes such as dispersing the solid particles in a polymer solution and changing the polarity of the solution to precipitate a part of the polymer on the particles (Japanese Patent Publication No. 91291 Sho. 40 (1965)) or dispersing a monomer and solid particles in an organic solvent capable of dissolving the monomer but incapable of dissolving a polymer of the monomer, and polymerizing the monomer in this state (British Pat. No. 1,156,653).

However, these processes are utilized mainly for coating particles of a dye, pigment or metal oxide and they are not suitable for coating metal particles with a polymer. Further, since an organic solvent should be employed in these processes, they suffer economic disadvantages if they are conducted on an industrial scale.

BRIEF SUMMARY OF THE INVENTION

It is, therefore, a primary object of the present invention to provide a process for easily preparing plastic coated metal powders by homogeneously mixing a monomer with a metal powder in an aqueous medium and polymerizing the monomer in the presence of an acidic sulfite ion.

Another object of the present invention is to provide plastic coated metal powders that can effectively be used for forming conductive plastics, molded articles for sintering and pressed powder magnetic cores.

Other and further objects, features and advantages of the present invention will be more fully apparent from the following detailed description.

DETAILED DESCRIPTION OF THE INVENTION

As a result of our research, it has been found that polymer coated metal powders that can effectively be used as materials for forming conductive plastics and molded articles for sintering can be obtained in an aqueous medium if an acidic sulfite ion is present.

More specifically, in accordance with the present invention, a polymer coated metal powder capable of forming a homogeneous composite of the metal powder and polymer can be provided by simple procedures if only the metal powder is contacted with a monomer in the presence of an acidic sulfite ion.

According to the process of the present invention, a metal powder is suspended in an aqueous solution, aqueous emulsion or aqueous suspension containing a radical-polymerizable monomer and the monomer is radical-polymerized in the presence of a substance capable of releasing an acidic sulfite ion ($HSO_3^-$) in the presence of water, such as aqueous sulfurous acid, sulfur dioxide and hydrogen salts of sulfurous acids. In the process of this invention, the order of addition of components is not particularly critical. It is possible to pour a monomer under agitation into an aqueous suspension containing a metal powder and an acidic sulfite ion and then carry out polymerization. It is also possible to add a metal powder to an aqueous solution containing a monomer and an acidic sulfite ion and then carry out polymerization under agitation. Formation of the acidic sulfite ion can be accomplished by blowing gaseous sulfur dioxide into the aqueous medium or adding liquid sulfur dioxide to the aqueous medium. It is also possible to add to the aqueous medium a solution of sulfurous acid or a hydrogen salt of sulfurous acid such as ammonium hydrogensulfite and sodium hydrogensulfite. An acidic sulfite ion can also be formed in the aqueous medium by employing a mixture of a sulfite and an acid.

Substantially all metals and metal alloys can be used in this invention. For example, there can be employed aluminum, iron, copper, nickel, chromium, zinc, palladium, silver, platinum, gold, rodium and lead and alloys of these metals. These metals are used in the form of powder or particles having a size of several millimeters to several microns.

Any radical-polymerizable monomer can be used for coating these metal powders. There can be mentioned, for example, styrene, vinyl acetate, vinyl chloride, acrylonitrile, acrylic acid esters, methacrylic acid esters, acrylic acid salts, methacrylic acid salts, divinyl benzene, N-methylol acrylamide and the like.

As the polymerization medium, there are employed water and mixed solvents of water and hydrophilic organic solvents such as alcohols.

In the process of the present invention, the monomer is used in an amount of 0.05 to 100% by volume based on the metal powder.

The acidic sulfite ion is present in the aqueous medium in concentration, as calculated as $HSO_3^-$, of 0.001 to mole/1, preferably 0.01 to 0.1 mole/1.

When the resulting coated metal powder is to be used as a raw material for forming conductive plastics and it is desired that the conductivity is not damaged, it is preferred that the amount of the polymer formed be reduced by decreasing the amount of the monomer used or lowering the degree of polymerization. When the resulting coated metal powder is used as a raw material for forming a pressed powder magnetic core and it is desired to reduce the electric conductivity, it is preferred that the monomer be used in a larger amount and the degree of polymerization be increased to thereby increase the amount of the polymer formed.

In the present invention, it is, therefore, possible to control the degree of coating on the metal powder as appropriate to the intended use of the product.

In the process of the present invention, the metal powder to be coated acts as a radical polymerization initiator, e.g., a peroxide used in the conventional processes need not be added for polymerization of the monomer. Of course, in this invention, it is permissible that such polymerization initiator may be used in combination. Further, since polymerization proceeds smoothly on the surface of the metal powder, the powder can be coated sufficiently with a small amount of the polymer. This is another advantage of the present invention.

The polymer coated metal powder obtained according to this invention can be used to produce various metal sintered products by heat-molding and then sintering. If the polymer coated metal powder is compressed under pressure, a molded article such as a pressed powder magnetic core can be obtained.

This invention will now be illustrated in more detail with reference to the following examples, which are not intended to limit the scope of the invention.

EXAMPLE 1

Gold powder (having a size of 200 mesh and a composition of 98.613% Ag and 0.693% Cu) was used as the starting metal powder and a gold powder coated with poly(methyl methacrylate) was prepared by the following method.

A 50 ml-volume three-neck flask was placed in a thermostat maintained at 50°C and the flask was charged with 4.72 g of the above starting gold powder, 1.0 g of methyl methacrylate and 20 ml of water. Then, 0.4 ml of 2N aqueous sulfurous acid was added under agitation to the charge in the flask. Reaction was carried out at 50°C for 4 hours and 20 minutes and the reaction product was recovered by filtration, washed sufficiently with water and dried at 120°C to obtain 4.84 g of a composition composed of a polymer and gold. When the resulting product was observed under an electron microscope, it was found that the gold particles were coated with the polymeric material. In the resulting composition, the content of the poly(-methyl methacrylate) was 2.5% by weight and the degree of polymerization was 11.5%.

The thus obtained composition was molded at 200°C and 50 Kg/cm$^2$ to obtain a square plate having a size of 10 cm × 10 cm × 2 cm. The specific resistance of the resulting molded article was $2.4 \times 10^{-5}\Omega$cm.

EXAMPLE 2

A 2 l-volume three-neck flast was placed in a thermostat maintained at 50°C and the flask was charged with 400 g of copper powder having a size of about 180 mesh, 35 g of methyl methacrylate, 5 g of methyl acrylate and 1.6 Kg of water. Then, 100 ml of 1N aqueous sulfurous acid was added to the charge of the flask under agitation and reaction was carried out at 50°C for 2 hours. The resulting product was recovered by filtration, washed sufficiently with water and vacuum dried at 100°C to obtain 435 g of a composition composed of a polymer and copper. When the product was observed under an electron microscope, it was found that the polymeric material had effectively coated the surfaces of the copper particles. From the infrared absorption spectrum and NMR spectrum, the polymeric material was identified as a copolymer of methyl methacrylate and methyl acrylate and the polymer content in the composition was 8.3% by weight.

The reason why the amount of copper in the resulting composition was smaller than the charged amount of copper is considered to be that impurities contained in the starting copper powder such as CuO was dissolved out in the aqueous phase.

The flexural strength of a molded article obtained by compression molding of the above composition at 180°C and 200 Kg/cm$^2$, and the molded article had insulating characteristics.

EXAMPLE 3

In the same manner as described in Example 2, a 1 l-volume -volume three-neck flask placed in a thermostat maintained at 50°C was charged with 100.0 g of copper powder having a size of about 180 mesh, 3.5 g. of methyl methacrylate, 400 g of water and 25 ml of 1N aqueous sulfurous acid, and reaction was carried out at 50°C for 4 hours. Then, the resulting product was recovered by filtration, washed with water and vacuum dried at 100°C to obtain 102.9 g of a composition composed of a polymer and copper. In the resulting composition, poly(methyl methacrylate) had effectively coated the copper powder and the polymer content was 3.0% by weight. When the thus obtained composition was compression molded at 180°C and 200 Kg/cm$^2$, there was obtained a molded article having a flexural strength of 120 Kg/cm$^2$ and a specific resistance of 1.2 X $10^{-5}\Omega$cm.

EXAMPLE 4

In the same manner as in Example 2, 20 ml of an aqueous solution of ammonium hydrogensulfite having a concentration of 1 mole/l was added to a suspension comprising 100.0 g of electrolytic iron power having a size of about 150 mesh, 8.0 g of methyl methacrylate and 400 g of water, and reaction was carried out at 50°C for 4 hours under agitation. The resulting slurry was filtered and the recovered solid was washed sufficiently with water and vacuum dried at 160°C to obtain 104 g of a composition composed of poly(methyl methacrylate) and iron, in which the polymer content was 4.1% by weight. The presence of a minute amount of iron ions was detected in the filtrate. When the thus obtained composition was compression molded at 180°C and 200 Kg/cm$^2$, there was obtained a molded article having a flexural strength of 85 Kg/cm$^2$ and a specific resistance of $7.4 \times 10^{-4}\Omega$cm.

EXAMPLE 5

Powder of 2-81 molybdenum Permalloy having a particle size of about 150 mesh and a composition of 2% of Mo, 81% Ni and 17% Fe was employed as the starting metal powder, and a polymer-Permalloy composition was prepared according to the following method.

A three-neck flask maintained at 50°C was charged with 400 g of the 2-81 molybdenum Permalloy powder, 40 g of methyl methacrylate, 1.6 Kg of water and 100 ml of 1N aqueous sulfurous acid and the mixture was reacted for 4 hours under agitation. The resulting product was recovered by filtration, washed sufficiently with water and vacuum dried to obtain 433 g of a composition composed of a polymer and Permalloy. When this composition was observed under an electron microscope, it was found that poly(methyl methacrylate) had effectively coated the particles of the Permalloy. The polymer content in the composition was about 7.6% by weight. When the above composition was compression molded at 180°C and 200 Kg/cm$^2$, there was obtained a molded article having a flexural strength of 210 Kg/cm$^2$ and insulating characteristics.

EXAMPLE 6

A 100 cc-volume three-neck flask placed in a thermostat maintained at 50°C was charged with 10.0 g of electrolytic iron powder having a size of about 150 mesh, 2.0 g of methyl methacrylate and 50 g of water, and 0.20 g of sodium hydrogensulfite was added to the charge of the flask under agitation. Reaction was carried out at 50°C for 6 hours and the resulting solid product was recovered by filtration, washed sufficiently with water and vacuum dried at 50°C to obtain 10.0 g of a solid, in which the content of poly (methyl methacrylate) was 1.2% by weight. When the thus obtained solid was observed under an electron microscope, it was found that the iron powder was coated with the polymer.

EXAMPLE 7

In the same manner as in Example 6, a 100 cc-volume three-neck flask was charged with 20.0 g of copper powder having a size of about 180 mesh, 4.0 g of styrene and 40.0 g of water, and the temperature was elevated to 90°C and 20 ml of 2N aqueous sulfurous acid was added to the charge of the flask under shaking. The charge of the flask was shaken for 4 hours in the sealed state. At this time, the styrene monomer was homogeneously dispersed on the copper surface. After completion of 4 hours' reaction, the product was recovered by filtration, washed with water and vacuum dried at 50°C to obtain 20.64 g of a solid, in which the polymer content was 3.3% by weight. A part of the copper was dissolved out into the aqueous solution phase and the loss of the copper component was due to dissolution of impurities such as CuO. When the recovered solid was observed under an electron microscope, it was found that the copper powder was coated with polystyrene.

What is claimed is:

1. A process for preparing plastic coated metal powder which comprises suspending a metal powder in an aqueous medium containing a radical-polymerizable monomer and initiating polymerization of said monomer with an initiator consisting essentially of acidic sulfite ions in the presence of said metal powder.

2. A process according to claim 1 wherein said monomer is at least one member selected from the group consisting of methyl methacrylate, methyl acrylate and styrene.

3. A process according to claim 1 wherein at least one member selected from the group consisting of aqueous sulfurous acid, ammonium hydrogensulfite and sodium hydrogensulfite is added to said aqueous medium to generate the acidic sulfite ions present in said aqueous medium.

4. A process according to claim 1 wherein said acidic sulfite ion is present at a concentration, calculated as $HSO_3^-$, of 0.038 to 0.7 mole/l.

5. A process according to claim 1 wherein said aqueous medium is water.

6. The process of claim 1 wherein said monomer is an ethylenically unsaturated monomer.

7. The process of claim 6 wherein said monomer is present in an amount equal to about 0.05–100% by volume of said metal powder.

8. The process of claim 1 wherein said medium is agitated during said polymerization.

* * * * *